US007052443B2

(12) United States Patent
Phillips

(10) Patent No.: US 7,052,443 B2
(45) Date of Patent: May 30, 2006

(54) MARTIAL ARTS PRACTICE DEVICE

(76) Inventor: Justin W. Phillips, 4119 Greenwood Pl., Enid, OK (US) 73703

( * ) Notice: Subject to any disclaimer, the term of this patent is extended or adjusted under 35 U.S.C. 154(b) by 282 days.

(21) Appl. No.: 10/386,727

(22) Filed: Mar. 12, 2003

(65) Prior Publication Data

US 2004/0180762 A1 Sep. 16, 2004

(51) Int. Cl.
*A63B 69/00* (2006.01)

(52) U.S. Cl. ..... 482/83; 482/88

(58) Field of Classification Search ..... 482/83–90, 482/105, 124, 148, 77, 79, 111, 112, 96, 128, 482/126; 473/215, 441–445
See application file for complete search history.

(56) References Cited

U.S. PATENT DOCUMENTS 2,620,188 A * 12/1952 Malagio ..... 473/442
3,427,021 A * 2/1969 Donato ..... 482/83
4,681,318 A * 7/1987 Lay ..... 473/423
4,732,378 A 3/1988 LeFebvre et al.
D320,428 S 10/1991 Rust
5,472,395 A * 12/1995 Trocchio ..... 482/83
5,690,597 A 11/1997 Enfaradi
5,803,875 A 9/1998 Colace
5,899,835 A * 5/1999 Puranda ..... 482/90
5,913,756 A * 6/1999 Glaser ..... 482/128
D420,413 S * 2/2000 Gonzalez ..... D21/798
6,152,865 A * 11/2000 Beauvoir ..... 482/140
6,616,582 B1 * 9/2003 Jiang ..... 482/140
6,736,764 B1 * 5/2004 Kapustka ..... 482/83

* cited by examiner

*Primary Examiner*—Jerome Donnelly
(74) *Attorney, Agent, or Firm*—Bracewell & Giuliani LLP

(57) ABSTRACT

A kicking exercise device includes a frame adapted to be held by a first user. A head portion is carried by the frame through a coil spring. When a blow is delivered by a second user, the head portion deflects relative to the frame.

6 Claims, 1 Drawing Sheet

MARTIAL ARTS PRACTICE DEVICE

BACKGROUND OF THE INVENTION

1. Field of the Invention

The present invention generally relates to exercise devices, more particularly, to exercise devices especially adapted for practicing martial arts.

2. Description of the Related Art

In the martial arts there are numerous maneuvers that are carried out, some of which involves the arms and hands, whereas some others involve the legs and feet. Whatever martial arts maneuvers are contemplated, it is a good idea for a martial arts practitioner to carry out exercises that help build strength and endurance for carrying out the maneuvers. Particularly, kick boxing, which involves striking blows with one's feet, requires extensive practice.

U.S. Pat. No. 5,690,597, titled "Martial Arts Exercise Apparatus", teaches a martial arts training device for gripping by a user. A target assembly can be attached to a frame by a series of linking bars that are locked to position the target at a desired position. The target is used for kick practice.

While workable, improvements are desired, particularly by making the target react more realistically to practice blows.

SUMMARY OF THE INVENTION

The present invention is directed to a kicking exercise device. This device advantageously includes a frame adapted to be held by a user, a coil spring and a head portion carried by the frame through the coil spring. When a blow is delivered, the head portion deflects relative to the frame.

This device further advantageously includes a frame having a stock for abutting against a user and a central portion with a pair of handles; a coil spring mounted to a forward end of the frame; a neck portion with a rearward end being connected to the coil spring; and a head portion attached to a forward end of the neck portion. The stock advantageously has a longitudinal axis and the neck portion extends at an angle relative to the longitudinal axis of the stock.

The present invention is further directed to a method of practicing kicking. A practitioner would deliver a blow to a head portion carried by a frame held by an assistant. The head portion is rigidly joined to a neck portion, which is connected to the frame through a coil spring.

The foregoing and other advantages of the present invention will be apparent to those skilled in the art, in view of the following detailed description of the preferred embodiment of the present invention, taken in conjunction with the accompanying drawings.

BRIEF DESCRIPTION OF THE DRAWINGS

The novel features believed characteristic of the invention as well as a preferred mode of use, further objectives, and advantages thereof, will best be understood by reference to the following detailed description of an illustrative embodiment when read in conjunction with the accompanying drawings, wherein.

DETAILED DESCRIPTION OF THE PREFERRED EMBODIMENTS

Figure 1:
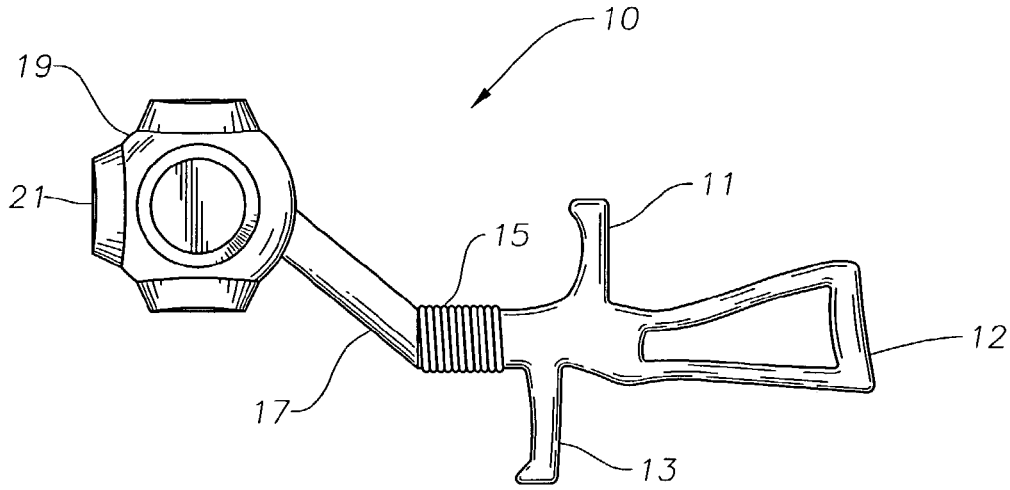
FIG. 1 is a perspective view of the martial arts exercise device in accordance with the invention.
Figure 2:
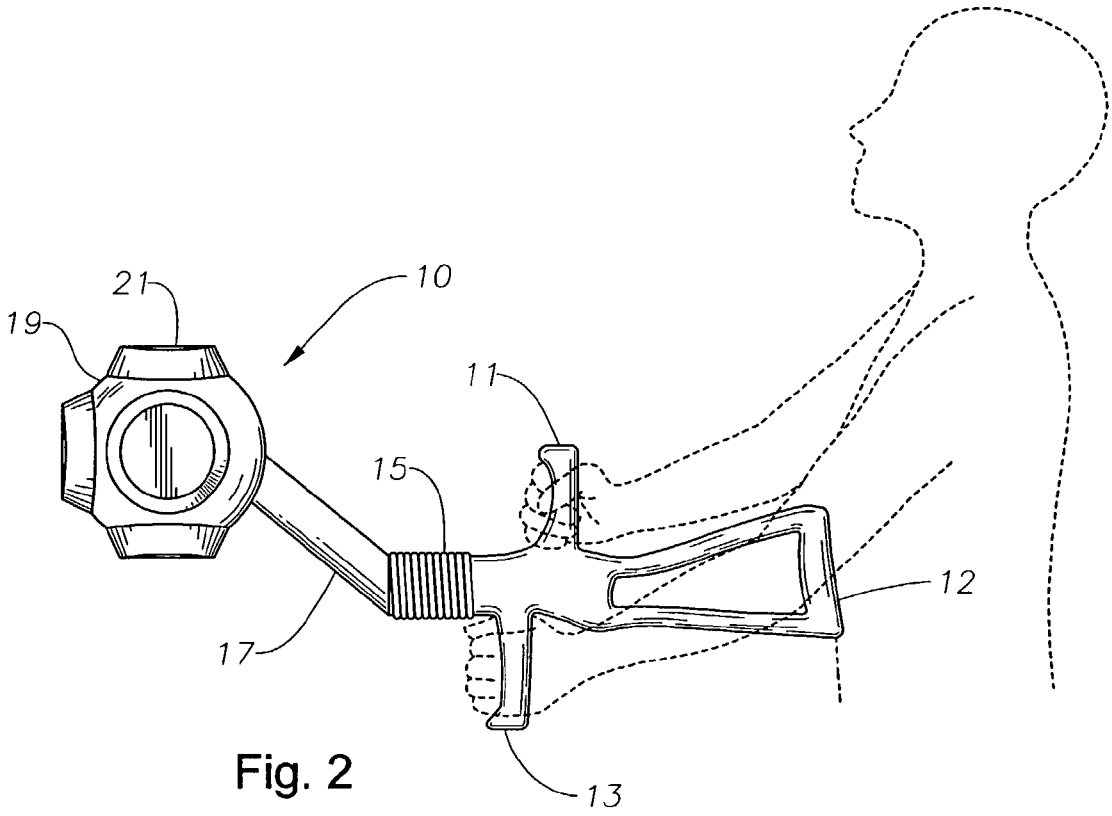
FIG. 2 shows the same perspective view of FIG. 1 and the device being held by a user t to the practitioner) in accordance with the present invention.

As illustrated in FIGS. 1 and 2, the martial arts practice device 10 preferably has a tubular frame including a stock 12 with its rearward end being placed against an assistant and a pair of handles 11 and 13. Two handles 11, 13 are positioned at the forward end of the stock and extend in the plane of the stock in opposite directions. The top handle 11 and bottom handle 13 are generally perpendicular to the longitudinal axis of the stock 12, with the top handle 11 being closer to the rearward end of the stock than the bottom handle 13.

The martial arts practice device 10 also preferably has a neck portion 17 having forward and rearward ends with the rearward end being closer to the tubular frame. A coil spring 15 is generally coaxial with the longitudinal axis of the stock 12 and connects the neck portion 17 at the rearward end thereof to the stock 12. The neck portion 17 preferably extends upward relative to the longitudinal axis of the coil spring 15 forming an obtuse angle of about 150 degrees.

The martial arts practice device 10 also preferably has a head portion 19. The head portion 19 is rigidly attached to the neck portion 17 at the forward end of the neck portion. The head portion 19 is generally spherical with flattened portions 21 on the forward side and both lateral sides. Flat portions 21 are preferably circular and raised on conical platforms from the spherical portion of the head portion 19. The flat portions 21 on the lateral sides are parallel to each other. A line normal to the flat portions 21 on the forward side is parallel with the longitudinal axis of the stock. The coil spring 15 is preferably stiff and resilient enough to maintain the head portion 19 in position where delivering a blow would cause the head portion 19 to deflect.

In operation, an assistant grasps the top and bottom handles 11 and 13 in his hand and holds the stock about his hip level or against his shoulder. This places the head portion 19 about the average height of a person's head. A practitioner tries to kick or punch the head portion 19, while the assistant moves the device 10 in various ways to simulate one ducking or moving his head to avoid being kicked or punched. The coil spring 15 located on the neck portion 17 allows for the simulation of human head movement and absorbs the shock of any kick or punch. Additionally the coil spring 15 lets the head portion 19 deflect laterally and up and down relative to the stock 12. This device can also be turned over and used invertedly with the neck portion 17 extending downward for lower level practice.

Besides martial arts, the above device can be used for practicing kickboxing, boxing, or simply hitting something for fun. This device is designed for the purpose of assisting both children and adults with their kicking and punching exercises. A toy version of the practice device will be lightweight for mobility yet heavy duty enough to absorb any kick or punch.

While the invention has been shown in only a few of its forms, it should be apparent to those skilled in the art that it is not so limited but susceptible to various changes without departing from the scope of the invention.

What is claimed is:

1. A kicking exercise device, comprising:

a frame having a rearward end and a forward end;

a coil spring secured to the forward end of the frame;

a neck portion having rearward and forward ends, the rearward end being connected to the coil spring;

a head portion connected to the forward end of the neck portion, the head portion being located forward of the forward end of the frame;

a pair of hand grips on the frame for gripping engagement by a first user, wherein delivering a blow to the head portion by a second user causes the head portion to deflect relative to the frame because of the coil spring; and wherein the neck portion inclines at an obtuse angle relative to a longitudinal axis of the frame.

2. The kicking exercise device of claim 1, wherein each of the hand grips extends transversely outward relative to a longitudinal axis of the frame.

3. A kicking exercise device, comprising:

a frame having rearward and forward ends and a longitudinal axis;

a pair of hand grips extending outward from the frame relative to the longitudinal axis for gripping by a first user;

a neck portion carried by the frame at the forward end of the frame, the neck portion extending at an inclined angle relative to the longitudinal axis and being located forward of the forward end of the frame;

a head portion carried by the neck portion; and a coil spring located between the frame and the head portion to allow the head portion to deflect relative to the frame when impacted by a second user.

4. The kicking exercise device of claim 3, wherein one of the hand grips is located closer to the rearward end of the frame than the other of the hand grips.

5. A method of exercising kicking, comprising:

providing a frame with rearward and forward ends and a longitudinal axis, a neck portion carried by and located forward of the forward end of the frame, the neck portion having an angled axis that inclines at an obtuse angle relative to the longitudinal axis, a head portion carried by and at a forward end of the neck portion, and a coil spring located between the frame and the head to allow movement of the head relative to the frame;

having a first user hold the frame thereto; and having a second user kick the head portion while the first user holds the frame.

6. The method of claim 5, wherein the first user holds the frame by gripping the pair of hand grips that extend outwardly from the frame.

* * * * *